US010501901B2

(12) United States Patent
Anghileri et al.

(10) Patent No.: US 10,501,901 B2
(45) Date of Patent: Dec. 10, 2019

(54) GUARDRAIL CRASH ABSORBING ASSEMBLY

(71) Applicant: LINDSAY TRANSPORTATION SOLUTIONS, INC., Omaha, NE (US)

(72) Inventors: Marco Anghileri, Milan (IT); Valeria Di Giacomo, Seriate (IT); Roberto Brivio Colombo, Monza e Brianza (IT); Gerrit A. Dyke, Stockton, CA (US); Jeffrey M. Thompson, Sacramento, CA (US); Daniel Paul Dacayanan Loya, Elk Grove, CA (US)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 396 days.

(21) Appl. No.: 15/440,506

(22) Filed: Feb. 23, 2017

(65) Prior Publication Data

US 2018/0238003 A1 Aug. 23, 2018

(51) Int. Cl.
*E01F 15/00* (2006.01)
*E01F 15/04* (2006.01)
*E01F 15/14* (2006.01)

(52) U.S. Cl.
CPC ..... *E01F 15/0423* (2013.01); *E01F 15/143* (2013.01); *E01F 15/145* (2013.01)

(58) Field of Classification Search
CPC . E01F 15/0423; E01F 15/0438; E01F 15/143; E01F 15/145; E01F 15/146; E01F 15/148
USPC ..... 256/13.1; 404/10
See application file for complete search history.

(56) References Cited

U.S. PATENT DOCUMENTS 5,022,782 A 6/1991 Gertz et al.
5,851,005 A 12/1998 Muller et al.
5,947,452 A 9/1999 Albritton
5,967,497 A * 10/1999 Denman ..... E01F 15/143 256/13.1
6,022,003 A 2/2000 Sicking et al.
6,173,943 B1 1/2001 Welch et al.
6,293,727 B1 9/2001 Albritton
6,505,820 B2 1/2003 Sicking et al.
6,536,985 B2 3/2003 Albritton
6,719,483 B1 * 4/2004 Welandsson ..... E01F 15/143 404/6
7,059,590 B2 6/2006 Bronstad
7,101,111 B2 9/2006 Albritton
7,111,827 B2 9/2006 Sicking et al.
7,210,874 B2 5/2007 Albritton
7,516,945 B2 4/2009 Alberson et al.
7,530,548 B2 * 5/2009 Ochoa ..... E01F 15/0423 256/13.1
7,699,293 B2 4/2010 James
7,926,790 B2 4/2011 James
8,215,619 B2 * 7/2012 Leonhardt ..... E01F 15/025 256/13.1
8,360,400 B2 1/2013 Leonhardt et al.
(Continued)

FOREIGN PATENT DOCUMENTS

KR 1020150111765 A 10/2015

*Primary Examiner* — Matthew R McMahon
(74) *Attorney, Agent, or Firm* — Thomas R. Lampe

(57) ABSTRACT

A guardrail vehicle crash absorbing assembly including a braking structure at a panel joint including a tooth having a cutting portion for making a horizontal cut in a rail panel slidably moving relative to another rail panel.

13 Claims, 5 Drawing Sheets

(56) References Cited

U.S. PATENT DOCUMENTS

| | | | | |
|---|---|---|---|---|
| 8,424,849 | B2 * | 4/2013 | James | E01F 15/025 256/13.1 |
| 8,491,216 | B2 | 7/2013 | Dyke et al. | |
| 8,596,617 | B2 | 12/2013 | James | |
| 8,905,382 | B2 * | 12/2014 | Smith | E01F 15/143 256/13.1 |
| 9,416,508 | B2 * | 8/2016 | Welandson | E01F 15/143 |
| 9,453,312 | B2 * | 9/2016 | James | E01F 15/02 |
| 9,611,601 | B1 * | 4/2017 | Anghileri | E01F 15/04 |
| 2006/0011900 | A1 | 1/2006 | Ochoa | |
| 2006/0193688 | A1 | 8/2006 | Albritton | |
| 2007/0252124 | A1 | 11/2007 | Heimbecker | |
| 2018/0216303 | A1 * | 8/2018 | Dyke | E01F 15/143 |

* cited by examiner

FIG. 5
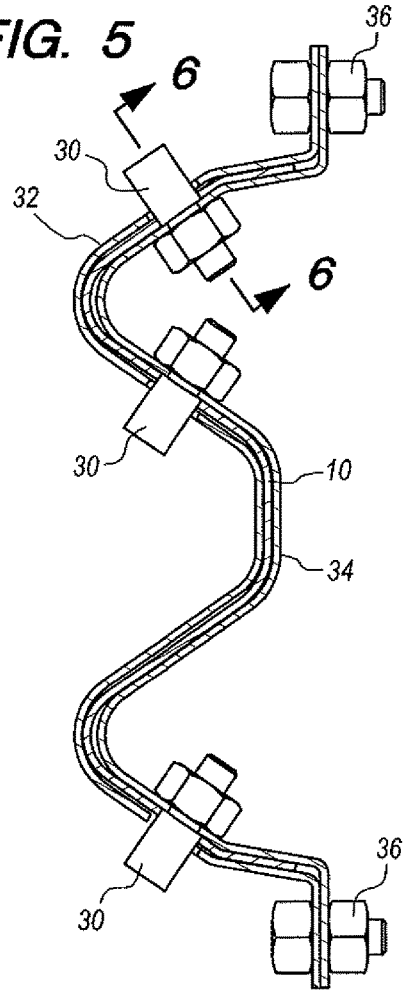
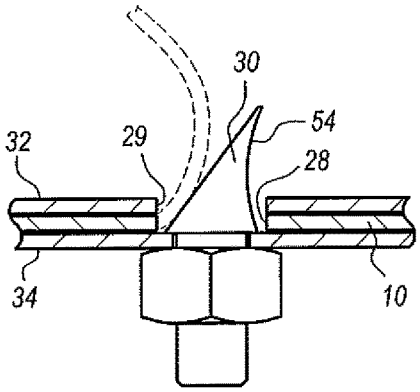
FIG. 6
FIG. 7
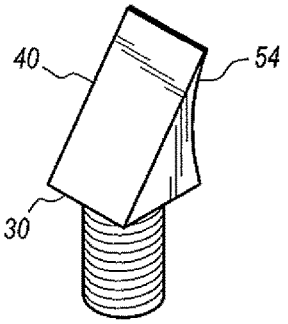
FIG. 8
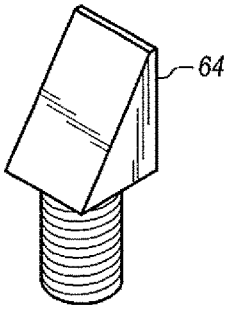
FIG. 9
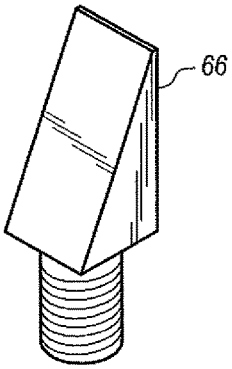
FIG. 10
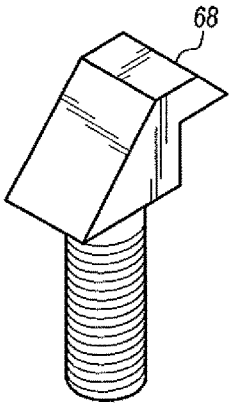

GUARDRAIL CRASH ABSORBING ASSEMBLY

TECHNICAL FIELD

This invention relates to apparatus for absorbing energy when impacted by a vehicle. More specifically, the apparatus relates to a guardrail crash absorbing assembly utilized as a barrier which dissipates the energy caused by impact of a moving vehicle impacting the assembly.

BACKGROUND OF THE INVENTION

It is well known to provide impact absorbing systems, often called "crash attenuators" or "crash cushions" in association with guardrails. The guardrails may be disposed along roadways or utilized adjacent to rigid structures such as pillars, bridge abutments, lighting poles and the like for the purpose of absorbing vehicle impact energy and minimizing the effects of impact on the vehicle, vehicle occupants and any ancillary structure being protected.

There are many forms and types of energy absorbing barriers. The following patents are believed to be representative of a variety of crash attenuator systems including patents disclosing such systems on or in connection with guardrails employing a plurality of overlapping side panels which are relatively movable and telescope in the event of a vehicle collision with the crash attenuator system: U.S. Pat. No. 8,596,617, issued Dec. 3, 2013, U.S. Pat. No. 8,491,216, issued Jul. 23, 2013, U.S. Pat. No. 7,926,790, issued Apr. 19, 2011, U.S. Pat. No. 5,022,782, issued Jun. 11, 1998, U.S. Pat. No. 5,851,005, issued Dec. 22, 1998, U.S. Pat. No. 7,699,293, issued Apr. 20, 2010, U.S. Pat. No. 8,360,400, issued Jan. 29, 2013, U.S. Pat. No. 7,516,945, issued Apr. 14, 2009, U.S. Pat. No. 7,059,590, issued Jun. 13, 2006, U.S. Pat. No. 6,173,943, issued Jan. 16, 2001, U.S. Pat. No. 6,022,003, issued Feb. 8, 2000, U.S. Pat. No. 5,947,452, issued Sep. 7, 1999, U.S. Pat. No. 7,111,827, issued Sep. 26, 2006, U.S. Pat. No. 7,210,874, issued May 1, 2007, U.S. Pat. No. 7,101,111, issued Sep. 5, 2006, U.S. Pat. No. 6,536,985, issued Mar. 25, 2003, U.S. Pat. No. 6,505,820, issued Jan. 14, 2003, U.S. Pat. No. 6,293,727, issued Sep. 25, 2001, U.S. Patent App. Pub. No. US 2006/0011900, published Jan. 19, 2006, U.S. Patent App. Pub. No. US 2006/0193688, published Aug. 31, 2006, U.S. Patent App. Pub. No. US 2007/0252124, published Nov. 1, 2007, and Korean Patent No. KR102015011765A, issued Oct. 6, 2015.

DISCLOSURE OF INVENTION

The present invention relates to a crash absorbing assembly.

The assembly includes an elongated first rail panel having a first rail panel front portion and a first rail panel rear portion.

The assembly also includes an elongated second rail panel having a second rail panel front portion and a second rail panel rear portion, the first rail portion rear portion and the second rail panel front portion being in side to side, overlapping relationship at a panel joint.

An end impact structure is operatively associated with the first rail panel and responsive to vehicle frontal impact on the end impact structure to move the first rail panel rearwardly lengthwise along the second rail panel.

A braking structure is at the panel joint for dissipating kinetic energy during sliding of the first rail panel relative to the second rail panel and absorb impact forces caused by rail vehicle impact on the end impact structure. The first rail panel defines a rail panel opening and the braking structure includes a tooth projecting from the second rail panel positioned in and extending through the first rail panel opening.

The tooth has a cutting portion for making a longitudinal cut in the first rail panel extending from the first rail panel opening responsive to endwise vehicle impact on the end impact structure.

Other features, advantages and objects of the present invention will become apparent with reference to the following description and accompanying drawings.

BRIEF DESCRIPTION OF DRAWINGS

FIG. 5 is an enlarged, cross-sectional view taken along line 5-5 in FIG. 3;

FIG. 6 is an enlarged, cross-sectional view of a portion of the assembly showing a tooth in position prior to telescoping of the assembly and prior to cutting by the tooth;

FIGS. 7-10 illustrate alternative teeth employable in the assembly; and

BEST MODE FOR CARRYING OUT THE INVENTION

Figure 1:
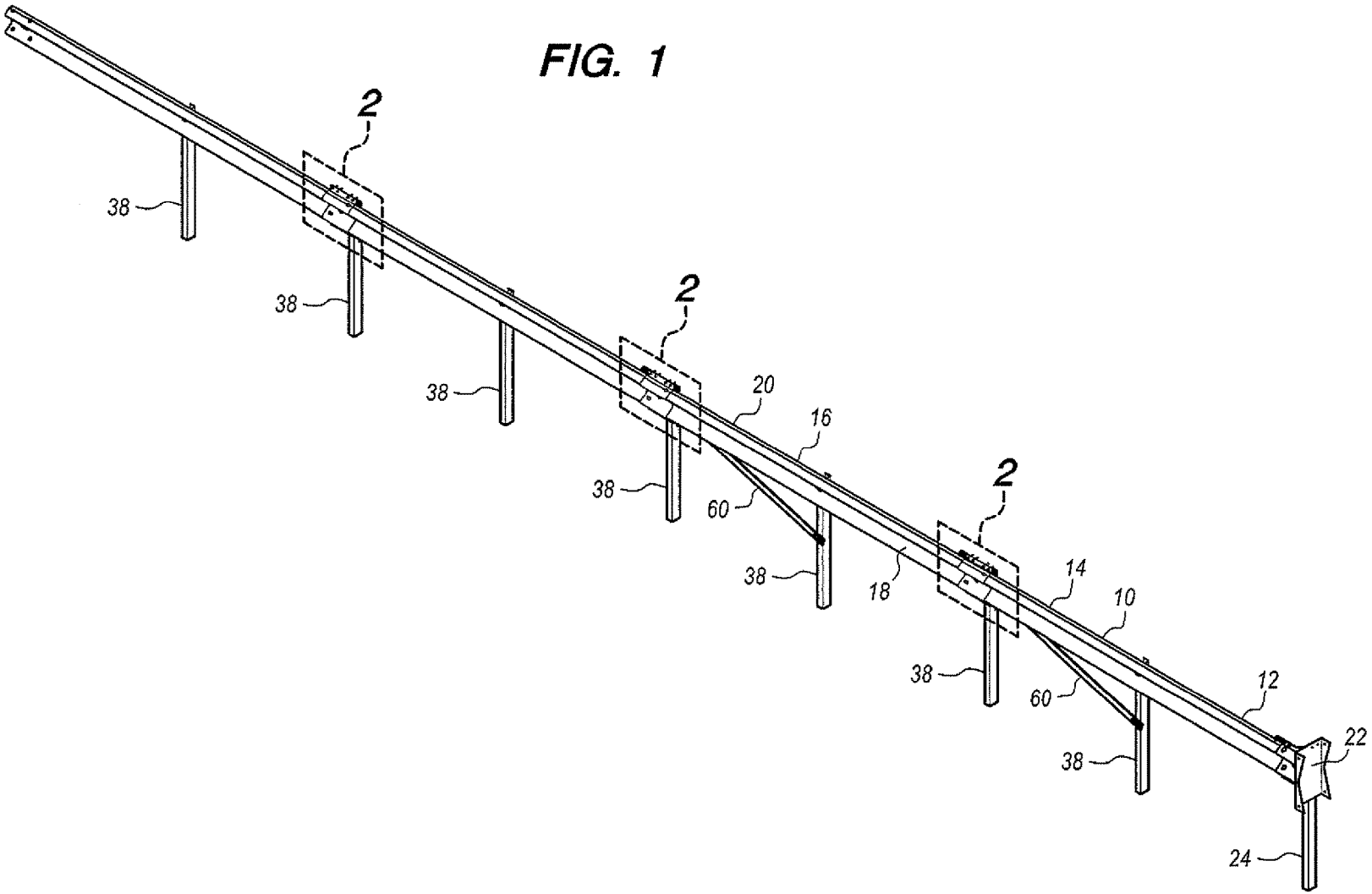
FIG. 1 is a perspective view of the guardrail crash absorbing assembly.
Figure 2:
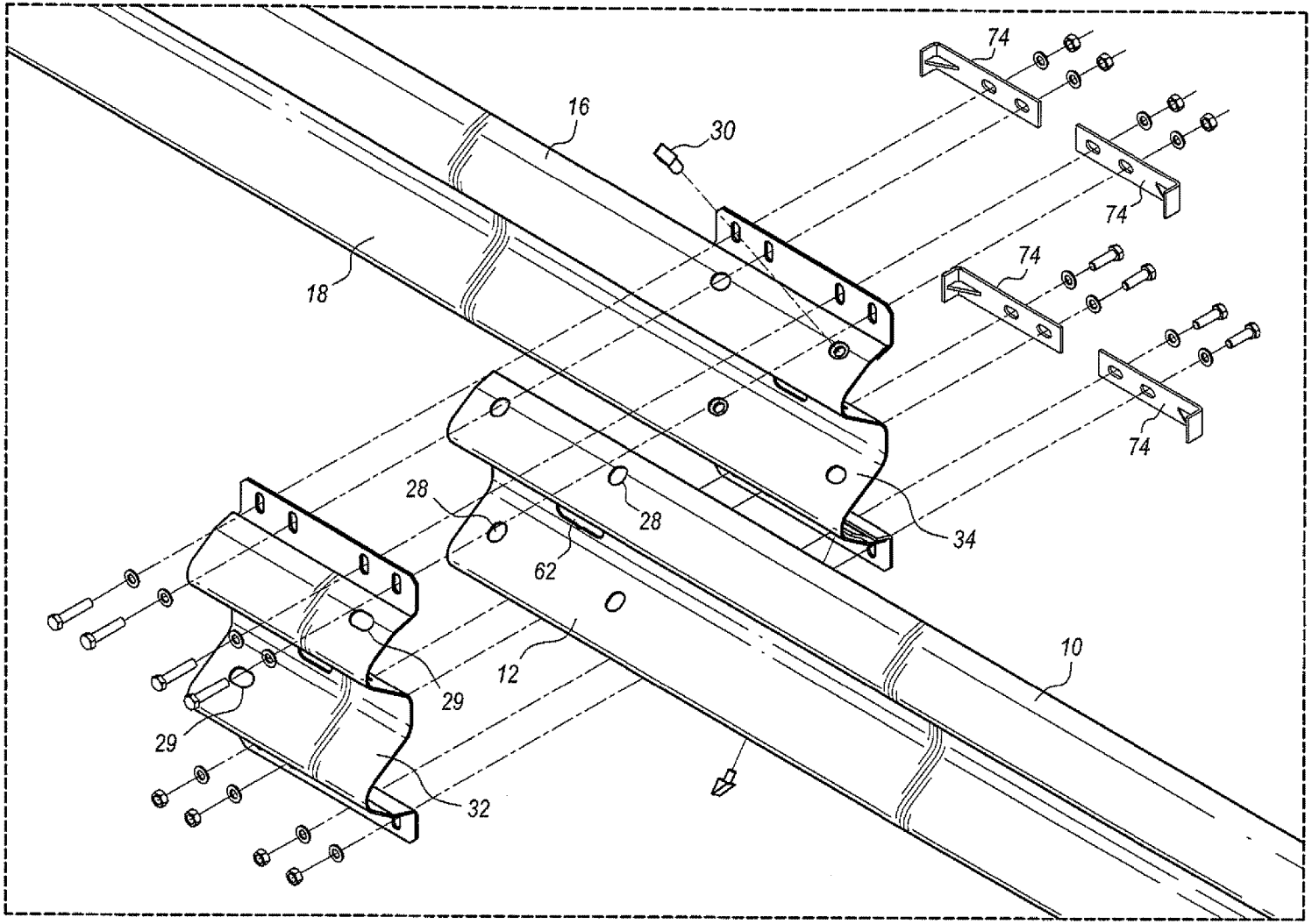
FIG. 2 is an exploded, perspective view illustrating portions of two guardrail panels and components of braking structure of the assembly designated by numeral 2 in FIG. 1.
Figure 3:
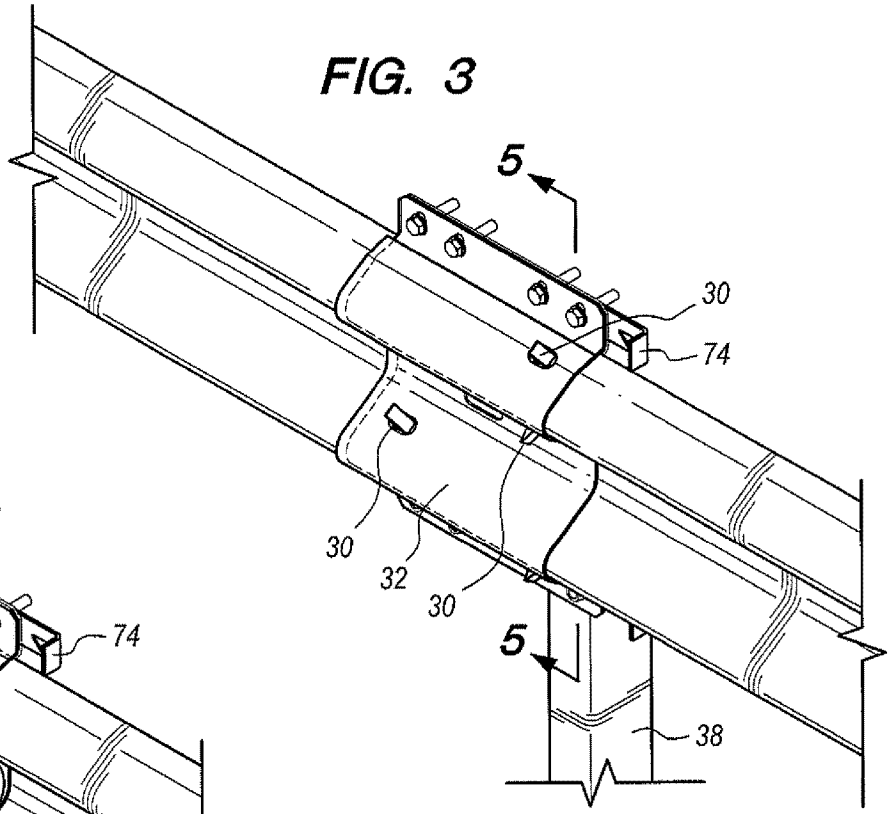
FIG. 3 is a perspective view illustrating the braking structure and guardrail panel portions supported by a post in the condition thereof prior to end impact by a vehicle.

Referring now to the drawings, a guardrail crash absorbing assembly constructed in accordance with the teachings of the present invention includes elongated first rail panel 10 having a first rail panel front portion 12 and a first rail panel rear portion 14. In the arrangement illustrated, there are three such assemblies, each defined by and identified by numeral 2.

The assembly also incorporates an elongated second rail panel 16 having a second rail panel front portion 18 and a second rail panel rear portion 20.

The first rail panel rear portion 14 and the second rail panel front portion 18 are in side by side, overlapping relationship at a panel joint.

An end impact structure including an impact head 22 is operatively associated with the first rail panel and responsive to vehicle frontal impact on the impact head to move the first rail panel rearwardly lengthwise along the second rail panel.

The impact head is attached to the first rail panel front portion of the most upstream assembly 2 and to a front support post 24 by screws, bolts or other suitable mechanical connectors.

Braking structure is located at the panel joint for dissipating kinetic energy during sliding of the first rail panel relative to the second rail panel and absorb impact forces caused by vehicle impact on the end impact structure. The first rail panel front portion defines a first rail panel openings 28 and the braking structure includes teeth 30 projecting from the second rail panel positioned in and extending through openings 28. As will be described in greater detail below, each tooth 30 has a cutting portion. The cutting portion of tooth 30 is utilized to make a longitudinal cut in the first rail panel extending from the rail panel openings 28 responsive to vehicle impact on the end impact structure. Thus, in the arrangement shown three longitudinal cuts are formed.

The braking structure at each assembly 2 additionally comprises a coupling structure at the panel joint defining coupling structure openings 29 in communication with the first rail panel openings 28, the teeth 30 located in and passing through both the rail panel openings 28 and the coupling structure openings 29.

More particularly, the coupling structure at each assembly includes a front slider section 32 in engagement with the first rail panel. The coupling structure also includes back slider structure 34 in engagement with the second rail panel 16. The front slider section 32 and the back slider section 34 are secured together and exert opposed forces on the first rail panel and the second rail panel at the friction joint.

The front slider section and the back slider section are secured together by mechanical connectors 36 adjustable to vary the opposed forces and vary the degree of engagement between the first rail panel and the second rail panel.

A plurality of support posts 38 are disposed along the length of the guardrail to support the rail panels thereof. At each assembly the back slider section 34 is attached to the guardrail support post 38 supporting the first rail panel rear portion and the second rail panel front portion at the panel joint.

Figure 4:
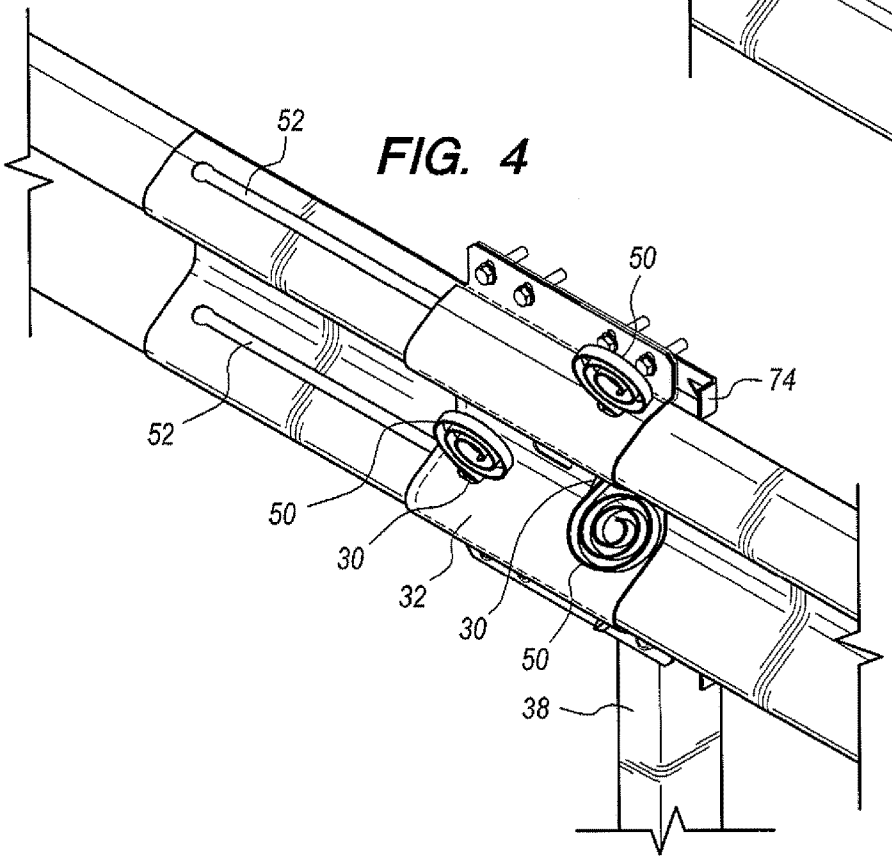
FIG. 4 is a view similar to FIG. 3, but illustrating the braking structure and guardrail panels after end impact by a vehicle.
Figure 11:
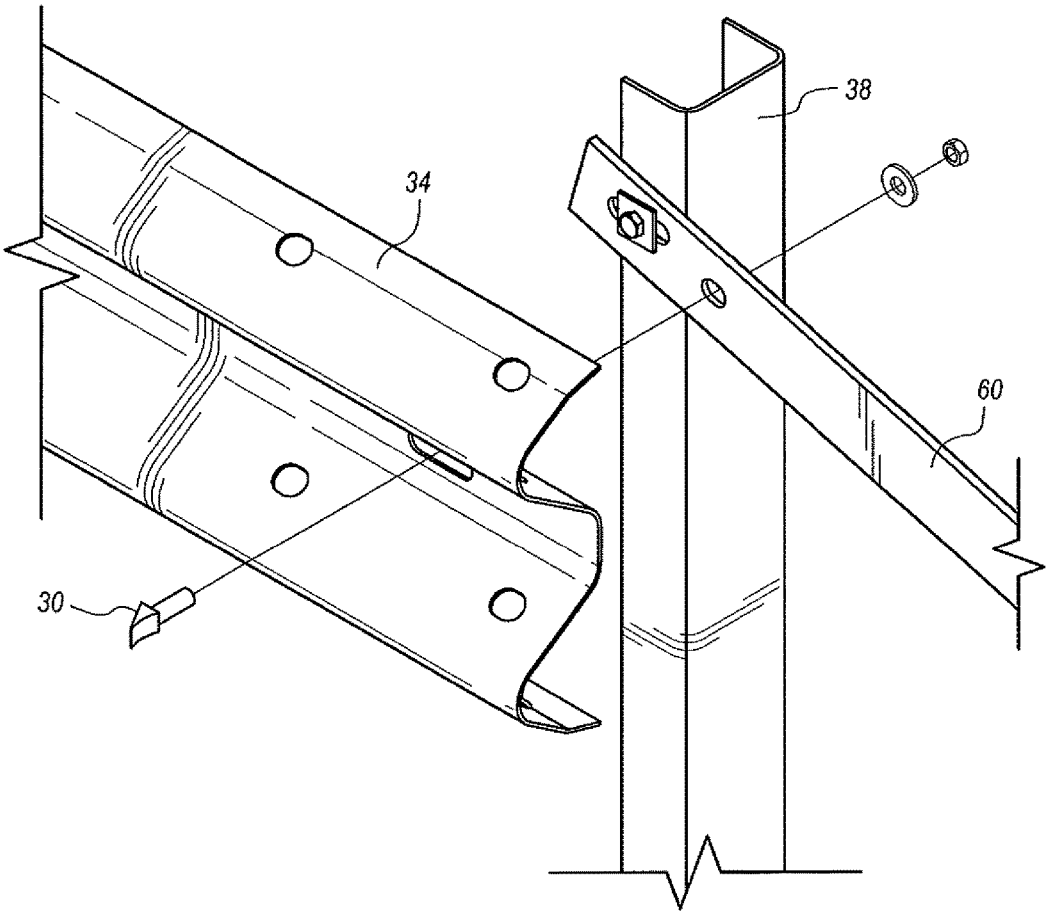
FIG. 11 is an exploded perspective view illustrating portions of a second rail, a post, a diagonal strut and cutting tooth.

Teeth 30 extend outwardly and the teeth have a cutting portion 40. The cutting portion 40 is positioned in rail panel opening 28 of the first rail panel. Upon rearward movement of the first rail panel caused by vehicle impact the teeth will cut strips 50 from the first rail panel and form longitudinal cuts 52, as shown in FIG. 4.

Teeth 30 also serve functions relating to the structural and operative integrity of the components at the panel joint. Teeth 30 have a hook end 54 engaging the outer surface of the front slider section.

In the event of sideways vehicle impact on the guardrail at or near the panel joint the connection between the structural components at the panel joint will remain intact and operable to redirect the vehicle along the guardrail in many instances. One of the teeth 30 at two of the assemblies is attached to and extends from an elongated strut 60 extending diagonally downwardly from support post 38 to an adjacent upstream support post 38 to add stability and strength to the system. That particular tooth passes through an elongated opening or slot 62 in the second rail front portion and slots in at least partial registry therewith formed in the first rail rear portion and front slider section.

FIGS. 8, 9 and 10 respectively illustrate other forms of teeth 64, 66, 68 which may be utilized in the assembly to perform tasks such as cutting, gouging, scraping or otherwise modifying the first rail panel to absorb crash energy upon telescoping.

As illustrated, and as referenced above, the guardrail crash absorbing assembly described above comprises one of a plurality of operatively associated and interconnected guardrail crash assemblies of like construction which operate consecutively during a frontal vehicle crash on the end impact structure to collapse and absorb crash energy. Three crash absorbing assemblies of like construction are identified by the number 2 in FIG. 1.

The back slider sections at the friction joints include abutment structures 74 in the form of L-shaped brackets attached by bolts and having reinforced bends which project both forwardly and rearwardly so that adjacent braking structures engage and prevent bottoming out of adjacent guardrail sections during guardrail collapse and limit relative outward flaring therebetween.

The invention claimed is:

1. A guardrail crash absorbing assembly comprising:

an elongated first rail panel having a first rail panel front portion and a first rail panel rear portion;

an elongated second rail panel having a second rail panel front portion and a second rail panel rear portion, said first rail panel rear portion and said second rail panel front portion being in side by side, overlapping relationship at a panel joint;

an end impact structure operatively associated with said first rail panel and responsive to vehicle frontal impact on the end impact structure to move said first rail panel rearwardly lengthwise along said second rail panel; and a braking structure at said panel joint for dissipating kinetic energy during sliding of said first rail panel relative to said second rail panel and absorb impact forces caused by vehicle impact on said end impact structure, said first rail panel defining a rail panel opening and said braking structure including at least one tooth projecting from said second rail panel positioned in and extending through said first rail panel opening, said at least one tooth having a cutting portion for making a longitudinal cut in said first rail panel extending from said first rail panel opening responsive to endwise vehicle impact on said end impact structure, said longitudinal cut extending at least partially through the first rail panel, said braking structure additionally comprising a coupling structure at said panel joint defining a coupling structure opening in communication with the first rail panel opening, said at least one tooth comprising a cutting tooth severing the first rail panel located in and passing through both the rail panel opening and the coupling structure opening, said coupling structure including a front slider section in engagement with said first rail panel, said coupling structure opening located in said front slider section, and a back slider section in engagement with said second rail panel, said front slider section and said back slider section secured together and exerting opposed forces on said first rail panel and said second rail panel at said panel joint, said front slider section and said back slider section secured together by mechanical connectors adjustable to vary the opposed forces and vary frictional engagement between said first rail panel and said second rail panel, said back slider section attached to a guardrail support post supporting said first rail panel rear portion and said second rail panel front portion at said panel joint, and said crash absorbing assembly including a second guardrail support post spaced upstream from the guardrail support post that supports said back slider section and an elongated strut attached to and extending diagonally downwardly from the guardrail support post that supports said back slider section attached to said second support post.

2. The guardrail crash absorbing assembly according to claim 1 wherein said cutting tooth is attached to said elongated strut and extends through said back slider section and said second rail panel.

3. The guardrail crash absorbing assembly according to claim 2 wherein said elongated strut has a lower end attached to the second guardrail support post spaced upstream at a ground engaging base end thereof to anchor the elongated strut to the ground.

4. The guardrail crash absorbing assembly according to claim 1 comprising one of a plurality of operatively associated and interconnected guardrail crash assemblies of like construction which operate consecutively during a frontal vehicle crash on the end impact structure to collapse and absorb crash energy produced at the end impact structure.

5. The guardrail crash absorbing assembly according to claim 1 wherein said coupling structure includes an abutment structure for abutting against an abutment structure of an adjacent panel joint to prevent bottoming out of adjacent rail panels at said panel joints.

6. The guardrail crash absorbing assembly according to claim 1 wherein said at least one tooth is one of a plurality of teeth in said guardrail assembly, at least one of said teeth extending from one of said first and second rail panels and frictionally engaging the other of said first and second rail panels to gouge or scrape the other of said first and second rail panels.

7. A guardrail crash absorbing assembly comprising:

an elongated first rail panel having a first rail panel front portion and a first rail panel rear portion;

an elongated second rail panel having a second rail panel front portion and a second rail panel rear portion, said first rail panel rear portion and said second rail panel front portion being in side by side, overlapping relationship at a panel joint;

an end impact structure operatively associated with said first rail panel and responsive to vehicle frontal impact on the end impact structure to move said first rail panel rearwardly lengthwise along said second rail panel; and a braking structure at said panel joint for dissipating kinetic energy during sliding of said first rail panel relative to said second rail panel and absorb impact forces caused by vehicle impact on said end impact structure, said first rail panel defining a rail panel opening and said braking structure including at least one tooth projecting from said second rail panel positioned in and extending through said first rail panel opening, said at least one tooth having a cutting portion for making a longitudinal cut in said first rail panel extending from said first rail panel opening responsive to endwise vehicle impact on said end impact structure, said longitudinal cut extending at least partially through the first rail panel, said at least one tooth being one of a plurality of teeth in said guardrail crash assembly and said at least one tooth having a hook structure and positioned in and extending outwardly through an elongated slot defined by said first rail panel and said second rail panel.

8. The guardrail crash absorbing assembly according to claim 7 wherein said hook structure additionally extends through a slot defined by said front slider section, said hook structure in engagement with the outer surface of said front slider section.

9. The guardrail crash absorbing assembly according to claim 7 wherein at least one of said plurality of teeth has a canted outer surface.

10. A guardrail crash absorbing assembly comprising:

an elongated first rail panel having a first rail panel front portion and a first rail panel rear portion;

an elongated second rail panel having a second rail panel front portion and a second rail panel portion, said first rail panel rear portion and said second rail panel front portion being in side by side, overlapping relationship at a panel joint;

an end impact structure operatively associated with said first rail panel and responsive to vehicle frontal impact on the end impact structure to move said first rail panel rearwardly lengthwise along said second rail panel; and a braking structure at said panel joint for dissipating kinetic energy during sliding of said first rail panel relative to said second rail panel and absorb impact forces caused by vehicle impact on said end impact structure, said first rail panel defining a rail panel opening and said braking structure including at least one tooth projecting from said second rail panel positioned in and extending through said first rail panel opening, said at least one tooth having a cutting portion for making a longitudinal cut in said first rail panel extending from said first rail panel opening responsive to endwise vehicle impact on said end impact structure, said longitudinal cut extending at least partially through the first rail panel, said braking structure additionally comprising a coupling structure at said panel joint defining a coupling structure opening in communication with the first rail panel opening, said at least one tooth comprising a cutting tooth severing the first rail panel located in and passing through both the rail panel opening and the coupling structure opening, said coupling structure including a front slider section in engagement with said first rail panel, said coupling structure opening located in said front slider section, and a back slider section in engagement with said second rail panel, said front slider section and said back slider section secured together and exerting opposed forces on said first rail panel and said second rail panel at said panel joint, said front slider section and said back slider section secured together by mechanical connectors adjustable to vary the opposed forces and vary frictional engagement between said first rail panel and said second rail panel, said guardrail crash absorbing assembly including slider abutment structures attached to said back slider section and projecting therefrom forwardly and rearwardly in diametric opposition relative thereto.

11. The guardrail crash absorbing assembly according to claim 10 wherein said slider abutment structures are operable upon telescoping of said first rail panel and said second rail panel to engage slider abutment structures of like construction on adjacent coupling structures to prevent bottoming out of said first rail panel and said second rail panel and limit relative outward flaring therebetween.

12. The guardrail crash absorbing assembly according to claim 11 wherein said slider abutment structures comprise L-shaped brackets attached to said back slider section by mechanical fasteners.

13. The guardrail crash absorbing assembly according to claim 12 wherein said L-shaped brackets have reinforced bends.

* * * * *